United States Patent [19]

Molins et al.

[11] 4,421,223

[45] * Dec. 20, 1983

[54] CONVEYOR SYSTEMS FOR CIGARETTES AND OTHER ROD-LIKE ARTICLES

[75] Inventors: Desmond W. Molins; Dennis Hinchcliffe; Peter A. Clarke, all of London, England

[73] Assignee: Molins Limited, London, England

[ * ] Notice: The portion of the term of this patent subsequent to Oct. 17, 1995 has been disclaimed.

[21] Appl. No.: 902,054

[22] Filed: May 2, 1978

Related U.S. Application Data

[62] Division of Ser. No. 408,256, Oct. 23, 1973, Pat. No. 4,120,391.

[30] Foreign Application Priority Data

Oct. 27, 1972 [GB] United Kingdom ..... 49787/72

[51] Int. Cl.[3] ..... B65G 15/14

[52] U.S. Cl. ..... 198/604

[58] Field of Search ..... 198/347, 601, 604, 607, 198/626, 688, 698, 699; 131/25

[56] References Cited

U.S. PATENT DOCUMENTS

| | | | |
|---|---|---|---|
| 417,065 | 12/1889 | Miller | 198/626 |
| 1,248,623 | 12/1917 | Cowley | 198/626 |
| 1,422,398 | 7/1922 | Wentz | 198/699 |
| 2,140,595 | 12/1938 | Rapley | 198/604 |
| 2,846,052 | 8/1958 | Heinemann et al. | 198/604 |
| 3,280,961 | 10/1966 | McCombie | 198/604 |
| 3,749,326 | 7/1973 | Aro | 198/626 |
| 4,120,391 | 10/1978 | Molins et al. | 198/607 |

*Primary Examiner*—Joseph E. Valenza

*Attorney, Agent, or Firm*—Antonelli, Terry & Wands

[57] ABSTRACT

A vertical feed apparatus for conveying a continuous stack of cigarettes upwards and/or downwards includes one or two bands which convey the stack around a rotatable member, from a horizontal conveyor to a pair of vertical conveyors, the bands being laterally offset from the horizontal and vertical conveyors.

5 Claims, 12 Drawing Figures

CONVEYOR SYSTEMS FOR CIGARETTES AND OTHER ROD-LIKE ARTICLES

This is a division of our application Ser. No. 408,256, filed Oct. 23, 1973, now U.S. Pat. No. 4,120,391, issued Oct. 17, 1978.

This invention is concerned with conveyor systems for cigarettes and other rod-like articles, including particularly cigarette filter rods. It is especially concerned with a device for conveying such articles upwards or downwards; such a device will, for convenience, be termed a "vertical feed," but it should be understood that the direction of movement need not necessarily be precisely vertical.

According to one aspect of this invention, a conveyor system to convey a stack of cigarettes or the like comprises a conveyor (which may, for example, be horizontal) having protrusions at regular intervals on its operative face which contacts the stack of cigarettes during use, and a pulley having a middle part around which the conveyor passes, and two coaxial outer parts, on opposite sides of the middle part and of a larger diameter than the middle part, for guiding the cigarettes in the region of the pulley.

Preferably the protrusions, when in the region of the pulley, lie entirely within the confines of the outer parts of the pulley, so that the cigarettes are guided entirely by the outer parts of the pulley in the region of the pulley; the outer extremity of the protrusions may, however, be flush with the peripheries of the outer parts of the pulley or with the outer surfaces of bands passing round those parts of the pulley. As a result of this pulley construction, the protrusions emerge from the space between the outer parts of the pulley without actually forcing their way into the stack of cigarettes. Instead, the stack of cigarettes gently expands to fill the space around the protrusions.

A preferred use of this invention is in a vertical feed, in which case the two parallel conveyors with protrusions are provided. This is believed to work, with the protrusions at suitable intervals along the conveyors, as a result of the articles forming a series of bridges between the protrusions on opposite conveyors. The protrusions on the opposite conveyors are preferably staggered.

One use for a vertical feed according to this invention is an elevator. However, it is also useful to convey articles downwards in a controlled manner in accordance with this invention so as to avoid the situation which can occur in a simple chute, especially a relatively long one, of excessive pressure being applied to the lowermost articles by the column of articles above; this is especially useful for cigarettes and other articles which require to be handled gently.

A vertical feed according to this invention is especially useful for filter-tipped cigarettes. With such cigarettes it sometimes happens that the filter is of larger diameter (and is normally in any case firmer) than the tobacco portion. Consequently in, for example, a normal chute, the filter ends of the cigarettes form a slightly thicker pile and thus progressively tilt the cigarettes. This tilting is minimised by the present invention since the cigarettes are re-aligned with the horizontal at regular intervals by the protrusions on the conveyors.

Examples of conveyor systems according to this invention are shown in the accompanying drawings. In these drawings.

Figure 1:
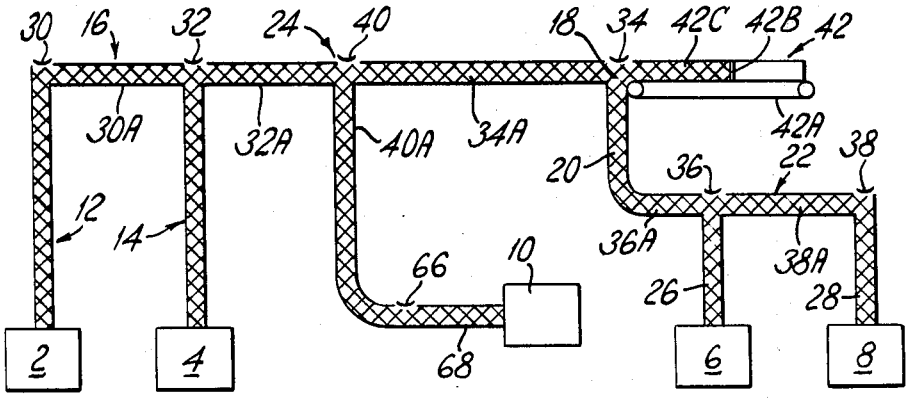
FIG. 1 shows diagrammatically a system for conveying cigarettes from two cigarette making machines to two packing machines.

FIG. 1 shows diagrammatically how two cigarette making machines 2 and 4 are arranged to supply cigarettes to two packing machines 6 and 8. In order to allow for differences between the cigarette supply and demand, for example when one making machine or one packing machine is out of operation, there is a storage device 10 which may, for example, be in the form described in Ser. No. 276,302, now U.S. Pat. No. 3,967,740, cognate with Ser. Nos. 380,219, now abandoned, and 380,243, now U.S. Pat. No. 3,851,748, i.e. that known as the Molins OLGA, and especially the reversible form of OLGA. The OLGA system is one in which sections of the stream of articles are conveyed to or delivered from successive compartments of a compartmented tray. However, the storage device 10 could in principle alternatively be a more conventional tray filling and tray unloading system, or a mass storage system. Another possibility is that the device 10 could be a conventional tray filling machine, and a conventional tray unloading machine could be connected to the system at a different position; for example at the junction 18 described further on.

Stacks of cigarettes are delivered upwards from the makers 2 and 4 by elevators 12 and 14 to an overhead conveyor system 16 by which the cigarettes are carried in stack formation to a junction 18. From this junction the cigarettes normally pass downwards through a chute 20 to an overhead conveyor system 22 from which the cigarettes pass downwards to the packing machines 6 and 8 through chutes 26 and 28.

Above the elevators and chutes there are the following sensors. Sensor 30 above the elevator 12 controls the speed of a conveyor 30A forming part of the overhead conveyor system; sensor 32 controls the speed of conveyor 32A; sensor 34 normally controls the speed of conveyor 34A; sensor 36 controls the speed of conveyor 36A (and possibly also the speed at which the cigarettes are fed down the chute 20 if the chute is a controlled feed comprising parallel bands in accordance with this invention); and sensor 38 controls the speed of conveyor 38A and possibly also the downward feed through the chute 28. A sensor 40 above the junction 24 controls the speed at which cigarettes are fed down or up a reversible vertical feed 40A leading to the storage device 10. A sensor 66 controls the direction and speed of a conveyor 68 leading to the storage device 10.

At the junction 18 there is also a buffer reservoir 42 consisting of a reversible band 42A which carries cigarettes into or out of the junction 18. Normally, while both makers and both packers are running (and assuming that supply equals demand so that the storage device is not required to operate) an end wall 42B on the band 42A remains at rest approximately at the position shown in FIG. 1, so that the buffer reservoir contains a stack of cigarettes 42C, for example 500 cigarettes. This reserve of cigarettes is fed into the junction 18 by the band 42A while the storage device 10 is temporarily stopped from delivering cigarettes on account of a tray change (or while a section of the stream is being plunged into the tray in the case of an OLGA storage device); that is to say while, for example, one maker has stopped and the deficiency is being made up from the storage device 10. On the other hand, when one packer is out of operation and cigarettes are accordingly being delivered into the storage device 10, then during tray changing of the device 10 the band 42A moves the end wall 42B of the buffer reservoir to the right so as to absorb the excess cigarettes (for example up to 400). After each tray change, the band 42 is arranged to return slowly to its normal intermediate position as shown in FIG. 1 to await its next period of operation.

While a packer is out of operation, during a tray change the conveyor 34A carries cigarettes to the right under the control of the sensor 40.

Figure 2:
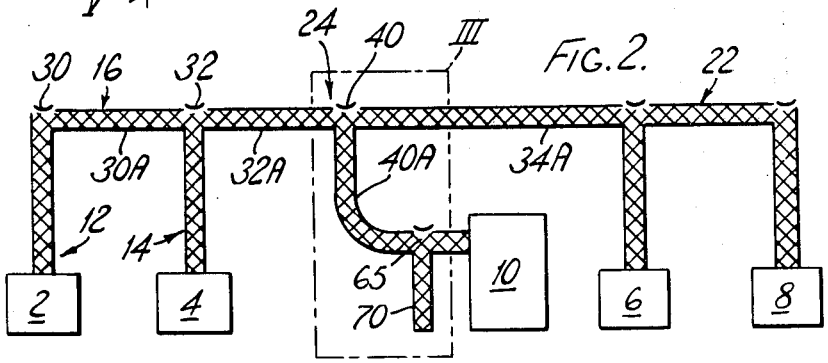
FIG. 2 shows a modification of the overall system shown in FIG. 1.

The system shown in FIG. 2 differs from that shown in FIG. 1 in that it has a buffer reservoir 70 extending vertically downwards from a junction 65. This buffer reservoir replaces the buffer reservoir 42 shown in FIG. 1. However, its operation is similar. It will be described further on with reference to FIG. 3, which is an enlarged view of the part of FIG. 2 contained within the chain-dotted outline III.

Figure 3:
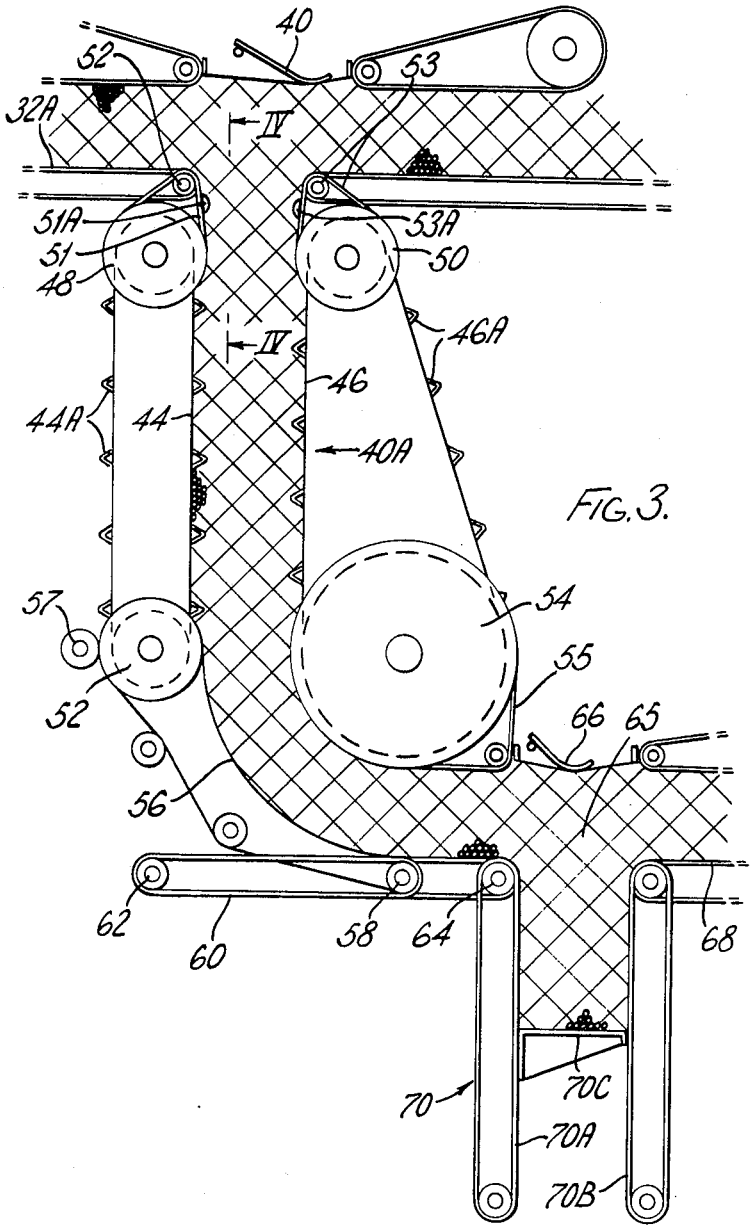
FIG. 3 is an enlarged view of part of the system of FIG. 2 within the chain-dotted outline III.

As shown in FIG. 3, the vertical fed 40A comprises parallel bands 44 and 46 formed with staggered protrusions 44A and 46A at regular intervals; these protrusions are wedge-shaped and will for convenience be termed "wedges." The bands are driven at the same speed, for example by upper pulleys 48 and 50. At their lower ends the bands pass round lower pulleys 52 and 54.

Figure 4:
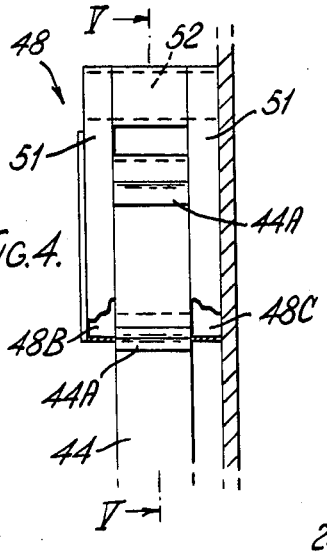
FIG. 4 is a fragmentary section on the line IV—IV in FIG. 2.
Figure 5:
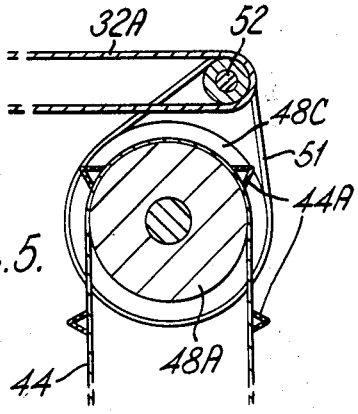
FIG. 5 is a section on the line V—V in FIG. 3.

Each of the pulleys 48, 50, 52 and 54 comprises a small-diameter middle part around which the band passes, and larger-diameter outer parts which guide the cigarettes in the region of the pulley (by contacting the cigarettes near their ends), so that the wedges are out of contact with the cigarettes in the region of the pulley. FIGS. 4 and 5 show the arrangement more clearly in relation to the pulley 48. The band 44 passes around the middle part 48A of the pulley, and on opposite sides of the middle part 48A there are larger-diameter parts 48B and 48C. FIGS. 4 and 5 also show two narrow bands 51 which pass around the large-diameter parts 48B and 48C and also passes around the small pulley 52 between the narrow bands 51.

A fixed strip 51A lies across the bands 51, being of the same length as and parallel to the cigarettes. A similar strip 53A lies across the opposed runs of similar bands 53. These strips help to maintain the cigarettes horizontal as they pass through the space between the opposed pairs of band 51 and 53.

Where the stack of cigarettes passes around the pulley 54, it is confined between parallel bands 55 (which pass around the large-diameter parts of the pulley 54) and parallel bands 56 which pass around the large-diameter parts of the pulley 52, extend along a curved path around the pulley 54 and return around a bottom end pulley 58. A conveyor band 60 lying between the bands 56 passes around pulleys 62 and 64 to convey the stack of cigarettes between the vertical feed 40A and the junction 65; the band 60 runs at a speed midway between the speeds of the bands 55 and 56, which have speeds proportional to their radial distances from the axis of the pulley 54. A sensor 66 lying above and responsive to the height of cigarettes in the junction 65 controls the speed and direction of a conveyor band 68 which carries cigarettes into or from the storage device 10 shown in FIG. 2.

The bands 56 are driven by the pulley 52 with the aid of a pressure roller 57. Thus the inner runs of the bands 56 are at a comparatively high tension while the bands are driving the cigarette stack upwards.

The buffer reservoir 70 comprises parallel bands 70A and 70B which are arranged to hold a vertically extending reserve stack of cigarettes, in place of the horizontal stack of FIG. 1. An end wall 70C is attached to the band 70A and is driven upwards or downwards to perform the same function as the conveyor 42A of the buffer reservoir 42 in FIG. 1. That is to say, the end wall 70C normally remains at an intermediate position and is driven upwards or downwards only while the storage device is temporarily stopped e.g. for tray changing. The speed of the bands 70A and 70B is predetermined and may be the same or different in opposite directions.

Figure 7:
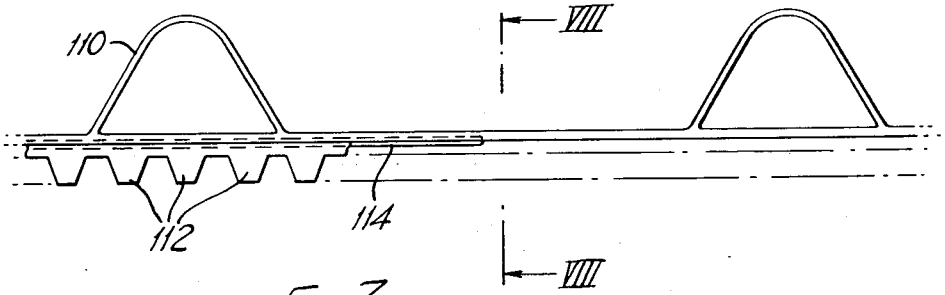
FIG. 7 is a side elevation of one form of toothed band which may be used instead of the band shown particularly in FIG. 4.

It will be appreciated that the vertical feed 40A shown in FIG. 3 could be used purely as an elevator; for example the elevators 12 and 14 in FIG. 1 could be in this form, for which purpose they may be combined with a stack-forming device as shown in FIG. 7, which will be described further on. Moreover, it should be noted that the height through which the cigarettes are elevated (or fed downwards) could be far greater than that shown in FIG. 2. Even if the cigarettes are fed upwards or downwards through, for example, three meters, the bridging of the cigarettes between the wedges on opposite bands tends to ensure that the lowermost cigarettes are not subjected to excessive pressure from the column of cigarettes above.

Instead of the makers and packers being at the same level, as shown in FIG. 1 and FIG. 2, the makers could, for example, be on a floor of the cigarette factory which is above or below the packers, and the combined output of the makers could be fed upwards or downwards through the appropriate floor by means of a vertical feed such as that shown in FIG. 3 but of greater length as necessary. Alternatively, the makers and packers could be on the same floor, and the storage device could be on a floor above or below them.

As already mentioned, FIG. 2 shows an overall system which is similar to that shown in FIG. 1, except that the buffer reservoir 70 is adjacent to the storage device 10, a further difference is that the overhead conveyor 22 above the packers 6 and 8 in FIG. 2 is at the same level as the overhead conveyor 16 above the makers 2 and 4, thus eliminating the chute 20.

It will be understood that where the various bands carry or support cigarettes (for example the operative inner runs of the bands 44 and 46 of the vertical feed) they are themselves supported by fixed backing plates, though these have been omitted for the sake of clarity.

Figure 6:
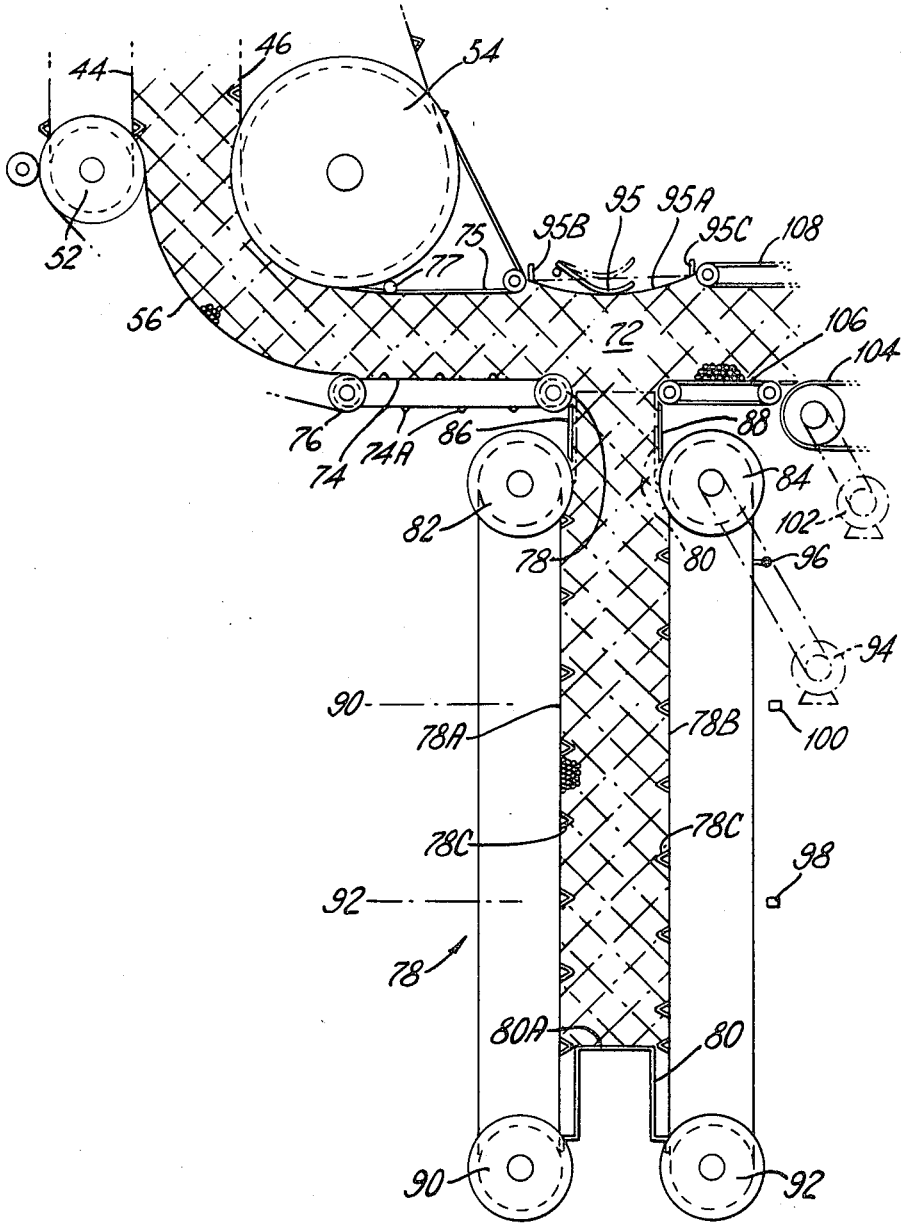
FIG. 6 shows a modification of part of the arrangement shown in FIG. 3.

FIG. 6 shows a modification of part of the apparatus shown in FIG. 3; members 52, 54 and 56 are the same as in FIG. 2. However, it should be noted firstly that the stack of cigarettes is fed between the vertical feed and a junction zone 72 by means of a lower band 74 which is formed with regularly spaced wedges 74A of which the height is approximately equal to a cigarette diameter, or possibly slightly less, e.g. half a cigarette diameter. The band 74 passes around relatively small-diameter middle portions of pulleys 76 and 78 which have larger-diameter outer parts to guide the cigarettes in the region of the pulleys; the arrangement of each pulley is basically similar to the pulley 48 as shown in FIGS. 4 and 5. The bands 56 pass around the outer parts of the pulley 76. The wedges 74A provide a grip on the stack of cigarettes which is useful for feeding the stack to the left and upwards into the vertical feed; as an alternative, the band 74 could be porous and suction could be applied through it to grip the bottom layer of cigarettes.

A top band 75 corresponding to the band 55 in FIG. 3 is arranged to rise by a height of one cigarette diameter immediately before the pulley 54 (i.e. while passing around a small pulley 77) to match the upward movement of the bottom of the stack as it moves from the band 74 and on to the pulley 76. As an alternative, however, the small pulley 77 could be omitted and the band 75 could have its lower run (i.e. the part in contact with the cigarettes) horizontal and tangential to the large-diameter outer parts of the pulley 54, so that the stack of cigarettes is gripped slightly more firmly as it enters the curved passage between the bands 75 and 56.

As shown in FIG. 6, a buffer reservoir 78 below a junction zone 72 (corresponding to the junction zone 65 in FIG. 2) comprises bands 78A and 78B which are formed with wedges 78C like the wedges 44A and 46A shown in FIG. 3 in the vertical feed. The bottom end wall of the buffer reservoir is formed by a member 80 of top hat section, the outwardly extending bottom edges being secured to the bands 78A and 78B. The main body of the wall member 80 is inwardly spaced from the bands so as to be able to pass upwards between top pulleys 82 and 84 and fixed walls 86 and 88 (i.e. to the position shown in dotted outline at the top of the buffer reservoir) to expel all the cigarettes from the buffer reservoir when necessary.

The buffer reservoir 78 shown in FIG. 6 is longer than is needed merely to cope with temporary stoppages of the storage device, e.g. for tray changing. The top 80A of the member 80 can move between levels 90 and 92, while both makers and both packers are in operation, to allow for small changes in cigarette supply and demand without setting in motion the storage device; for this purpose the bands 78A and 78B are driven by a motor 94 at a speed and in a direction controlled by a sensor 95 above the junction 72. The storage device begins to receive cigarettes or to deliver cigarettes into the system only when the top 80A of the wall member 80 reaches the level 90 or 92, at which point a roller 96 operates switch 98 or 100, whereupon a motor 102 drives a band 104 and bands 106 and 108 in the appropriate direction to feed cigarettes into or out of the storage device at a speed controlled by the sensor 95; following operation of one of the switches 98 and 100, the wall member 80 is driven automatically by the motor 94 to a position midway between the levels 90 and 92 where it waits until the motor 102 is stopped by the sensor 95 on reaching an upper or lower limit indicating that the storage device is no longer required to operate. Movement of the wall member 80 below the level 92 or above the level 90 occurs only during tray changing or other temporary stoppages of the storage device, as previously described.

It will be understood that the upper pulleys 82 and 84 around which the bands 78A and 78B pass are constructed similarly to the pulley 48 shown in FIGS. 4 and 5. Lower pulleys 90 and 92 may be similar or may be conventional pulleys.

The sensor 95, and possibly also the other sensors shown in the other figures, comprises a pivoted convex plate which rests on the cigarettes via a flexible membrane 95A. The ends of the membrane are anchored at 95B and 95C to confine the cigarettes in the junction zone.

As shown in FIG. 5, each of the wedges (e.g. 44A) may be hollow. The wedges may be made of a soft rubber or rubber-like material and may be secured to the bands by means of an adhesive or in any other effective way. By way of detailed example, the height of the wedges (i.e. the lateral extent from the bands) may be 20 mm. The distance between the large-diameter outer parts of the cooperating pulleys (e.g. the pulleys 52 and 54 in FIG. 3) may be about 90 to 115 mm; thus the distance between the bands 44 and 46 is 130 to 155 mm. The wedges are at a pitch of 100 mm.

Figure 8:
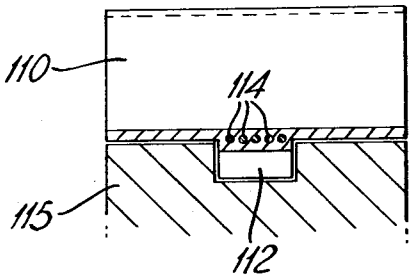
FIG. 8 is a section on the line VIII—VIII in FIG. 7.

FIG. 4 shows the bands of the vertical feed as plain bands which are friction driven. As an alternative, the bands could have teeth by which they are positively driven; by that means it is possible to ensure, for example, that the wedges on the opposed bands remain staggered. FIGS. 7 and 8 show one form of toothed band and FIGS. 9 to 11 show a different form.

As shown in FIGS. 7 and 8, the band comprises an integral moulding (for example, of polystyrene), with thin-walled wedges 110, teeth 112 and a number of reinforcing wires or cords 114. FIG. 8 shows also how each band, during its operative run, is supported at the back by a fixed guide 115 which has a longitudinal groove to accommodate the teeth 112.

Figure 9:
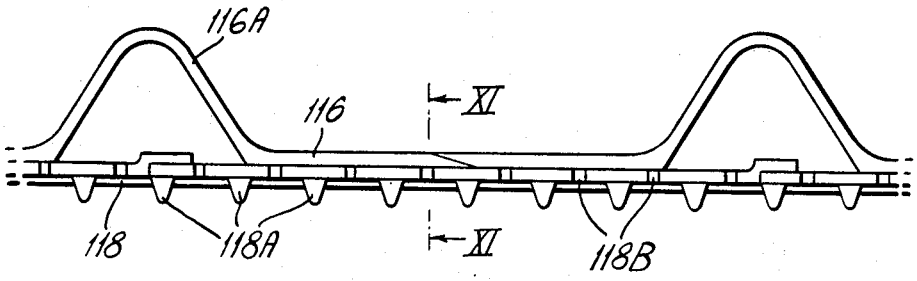
FIG. 9 is a side elevation of another form of toothed band.
Figure 10:
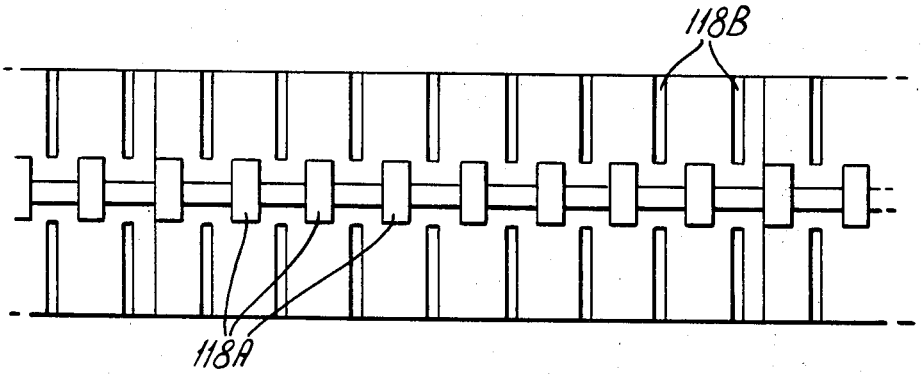
FIG. 10 is a view from underneath the band shown in FIG. 9.
Figure 11:
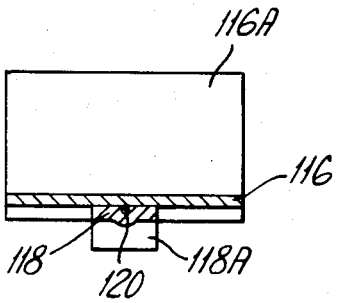
FIG. 11 is a section on the line XI—XI in FIG. 9.

FIGS. 9 to 11 show a composite form of toothed band comprising a layer 116 formed with integral hollow wedges 116A, and a layer 118 formed with teeth 118A and slots 118B (which may be omitted). These layers are bonded together with a single reinforcing wire or cord 120 (FIG. 11) interposed between them. Each of the layers may be formed from a number of short sections joined together end to end as shown, with the joints staggered. The layer 116 may, for example, be of soft rubber impregnated with styrene, while the layer 118 may be of the plastics material known by the trade name HYTREL.

It will be understood that where toothed bands are used, the cooperating central parts of the pulleys are correspondingly toothed.

Another possibility is that each of the conveyors forming the vertical feed may consist of an endless row of flat-surfaced members secured to a chain, for example as shown in FIGS. 1 to 7 of U.S. Pat. No. 2,954,113, with hollow wedges secured to some of the flat-surfaced members by screwed-on clamping strips. In that case the middle part of each pulley around which the chain passes is in the form of a sprocket.

Figure 12:
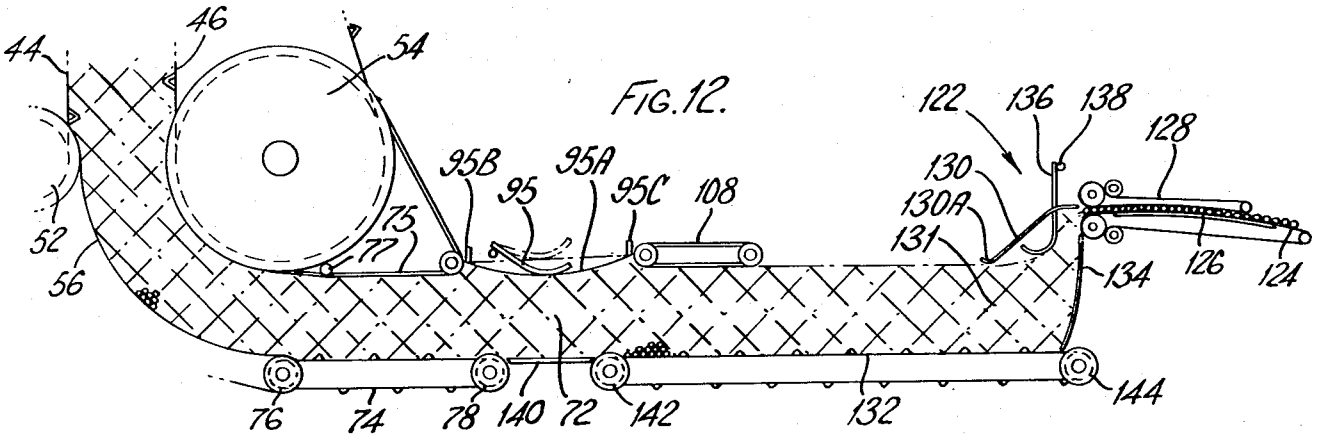
FIG. 12 shows an arrangement for feeding cigarettes from one of the cigarette making machines in the system shown in FIG. 1 or FIG. 2.

FIG. 12 shows a stack forming device 122 which can be used in cooperation with each of the cigarette making machines shown in FIGS. 1 and 2. Cigarettes are delivered by the cigarette making machine (not shown), on to a band 124 as a single row. The band 124 is constrained by a curved backing plate 126 to move along a curved path so that, with the co-operation of a top band 128, the cigarettes are gripped and driven to the left. After leaving the bands 124 and 128 the cigarettes are guided downwards by a plate 130. They thus form a stack 132 of cigarettes on a conveyor 132, the height of the stack being determined by the bottom edge 130A of the plate 130.

A fixed wall 134 extends downwards from the band 124 to the conveyor 132 as shown.

A sensor plate 136 attached to a pivot spindle 138 passes through a slot in the fixed plate 130 and rests on the cigarettes. The spindle 138 is connected to a mechanism (not shown) which continuously controls the speed of the conveyor 132 or simply switches it on and off when necessary to maintain a substantially constant stack height on the conveyor 132.

The stack feed system shown in FIG. 12 is otherwise generally similar to the arrangement shown in FIG. 6, as shown by the use of the same reference numerals where applicable, except that a fixed plate 140 supports the cigarettes at the zone 72 below the sensor 95, and the buffer reservoir 78 is omitted.

The conveyor band 132 passes around pulleys 142 and 144 which are similar to the pulley 78.

We claim:

1. A vertical feed for conveying a continuous stack of cigarettes upwards or downwards, comprising a first substantially horizontal conveyor, a pair of spaced parallel conveyors extending upwards from the horizontal conveyor and having their center lines in a vertical plane containing the center line of the horizontal conveyor, a rotatable member around which the stack of cigarettes are conveyed in passing between the first conveyor and the pair of conveyors, a band extending from positions adjacent to but laterally offset from the first conveyor and one of the pair of conveyors, and defining the outer periphery of a curved passage extending part of the way around the rotatable member for the conveyance of the cigarettes between the first conveyor and the pair of conveyors, and means for driving said band at a speed greater than the peripheral speed of said rotatable member.

2. A vertical feed according to claim 1 including an additional band which is parallel to and is driven in unison with the first conveyor and confines the upper surface of the stack of cigarettes on the first conveyor.

3. A vertical feed according to claim 1 or claim 2 in which the pair of conveyors includes, on the opposed surfaces of the conveyors, protrusions at intervals along the conveyors to engage the cigarettes.

4. A vertical feed according to claim 1 in which the first conveyor has protrusions at intervals along its length to engage the cigarettes on it during use.

5. A vertical feed according to claim 1, including a second band extending from positions adjacent to but laterally offset from the first conveyor and one of the pair of conveyors, the two bands being on opposite sides of the first conveyor and pair of conveyors and being arranged to support the cigarettes in the region of their ends.

* * * * *